United States Patent [19]

De Nora et al.

[11] 4,381,979

[45] May 3, 1983

[54] ELECTROLYSIS CELL AND METHOD OF GENERATING HALOGEN

[76] Inventors: Oronzio De Nora, Piazza della Repubblica 19; Antonio Nidola, Via Farneti 5; Gian N. Martelli, Via Padova 194, all of Milan, Italy

[21] Appl. No.: 268,431

[22] Filed: May 29, 1981

Related U.S. Application Data

[63] Continuation-in-part of Ser. No. 212,172, Dec. 2, 1980, which is a continuation-in-part of Ser. No. 102,629, filed Dec. 11, 1979. Pat. No. 4,340,452.

[30] Foreign Application Priority Data

Oct. 21, 1980 [IT] Italy ..... 25483 A/80

[51] Int. Cl.[3] ..... C25B 1/34

[52] U.S. Cl. ..... 204/98; 204/128; 204/283

[58] Field of Search ..... 204/98, 128, 283

[56] References Cited

U.S. PATENT DOCUMENTS 4,340,452 7/1982 De Nora ..... 204/263

*Primary Examiner*—R. L. Andrews

*Attorney, Agent, or Firm*—Pollock, Vande Sande & Priddy

[57] ABSTRACT

Halogen is produced by electrolyzing an aqueous halide in a specially designed cell. The cell comprises an anolyte chamber and a catholyte chamber separated by a permeable membrane or diaphragm, notably an ion exchange (generally cation exchange) polymer. At least one electrode comprises at least two sections. One section comprises a gas and electrolyte permeable layer, sheet or mat having a catalytic surface, i.e. one having a low overvoltage, (low hydrogen overvoltage if the cathode and low halogen overvoltage if the anode). This layer is spaced from the membrane by a second section comprising a thin intermediate electroconductive layer, screen or coating which is in contact with the membrane on one side thereof, the other side thereof being in contact with the main cathode.

This second or spacer section advantageously has an electrode surface having a higher overvoltage than the first electrode surface. Preferably the cathode has the above construction.

Upon electrolysis of alkali metal chloride or other halide in such a cell and with a cathode of the type described above, a low voltage is obtained even at high current densities and the cathode efficiency is high.

The spacer may be in the form of a thin porous coating of metal or the like bonded to or in close contact with the membrane or it may be in the form of a gas and electrolyte permeable screen interposed between the membrane and the lower overvoltage section.

22 Claims, 2 Drawing Figures

ELECTROLYSIS CELL AND METHOD OF GENERATING HALOGEN

Figure 1:
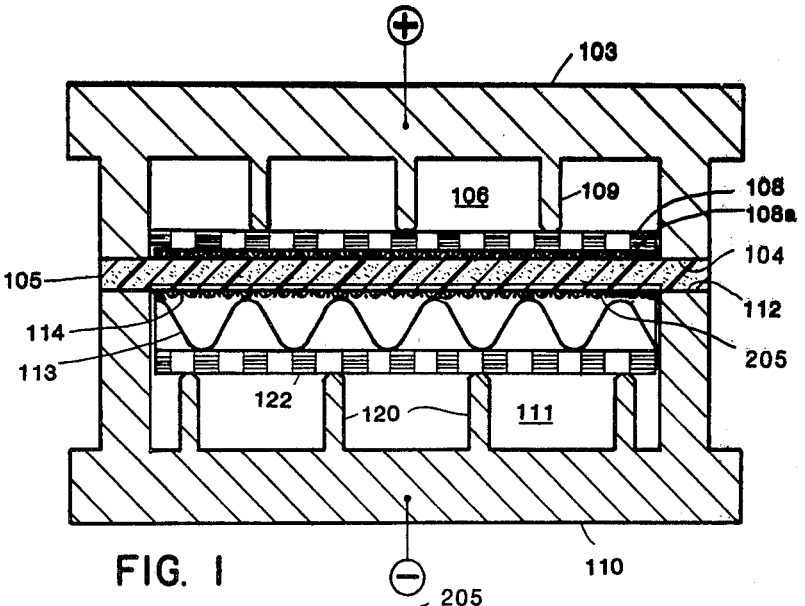

This application is a continuation in part of application Ser. No. 212172 filed Dec. 2, 1980 for U.S. patent, which in turn is a continuation-in-part of U.S. patent application Ser. No. 102,629, filed Dec. 11, 1979 and now U.S. Pat. No. 4,340,452.

The invention herein is directed to electrolysis of an aqueous electrolyte and is particularly concerned with generating elemental halogen by electrolyzing an aqueous halide, such as hydrochloric acid or alkali metal chloride to generate elemental chlorine.

STATE OF THE ART

It is known to electrolyze aqueous alkali metal chloride or like halide in a membrane cell having an ion exchange (normally cation exchange) membrane which separates anode from cathode. Since the membrane itself is generally impermeable or substantially so to gas and liquid flow, the electrolysis generates chlorine at the anode and alkali at the cathode, the alkali being of high purity and containing only very low chloride concentration.

One type of cell which has been proposed for such electrolysis is the solid polymer electrolyte cell.

A solid polymer electrolyte cell is characterized by an ion exchange membrane, which separates electrode of the cell and by the fact that one or preferably both electrodes are in contact with the membrane. The solid polymer electrolyte cells present (with respect to conventional membrane cells in which the cathode and frequently both anode and cathode are separated from the membrane), several advantages useful in different electrolysis processes. More precisely:

(1) The overall voltage between electrodes is lower because the interelectrodic distance is reduced practically to the membrane thickness.

(2) The so-called "bubble effect" is eliminated or at least minimized, i.e. the difficulty normally encountered in electrolytic processes where gas is evolved at the electrode accumulates in the zone between electrodes is avoided because evolved gas can be released behind the electrodes to the inside of the cell compartment.

(3) The cells may be very compact and thus the ohmic drops at the current distribution structures can be reduced.

The ion permeable diaphragms are cation exchange polymers in the form of thin flexible sheets or membranes. Generally, they are imperforate and do not permit a flow of anolyte into the cathode chamber but it is has also been suggested that such membranes may be provided with some small perforations to permit a small flow of anolyte therethrough, although the bulk of the work appears to have been accomplished with imperforate membranes.

Typical polymers which may be used for this purpose include fluorocarbon polymers such as polymers of trifluoroethylene or tetrafluoroethylene or copolymers thereof which contain ion exchange groups are used for this purpose. The ion exchange groups normally are cationic groups including sulfonic acid, sulfonamide, carboxylic acid, phosphoric acid and the like, which are attached to the fluorocarbon polymer chain through carbon and which exchange cations. However, they may also contain anion exchange groups. Typical such membranes have the general formula:

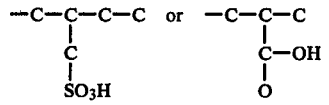

Such membranes include typically those fluorocarbon ion exchange polymers manufactured by the Du Pont Company under the trade name of "Nafion" and by Asahi Glass Company of Japan under the trade name of "Flemion". Patents which describe such membranes include British Pat. No. 1,184,321 and U.S. Pat. No. 3,282,875 and U.S. Pat. No. 4,075,405.

Since these diaphragms are ion permeable but do not permit anolyte flow therethrough, little or no halide ion migrates through the diaphragm of such a material in an alkali chloride cell and therefore the alkali thus produced contains little or no chloride ion. Furthermore, it is possible to produce a more concentrated alkali metal hydroxide in which the catholyte produced may contain from 15 to 45% NaOH by weight or even higher. Patents which describe such a process include U.S. Pat. Nos. 4,111,779 and 4,100,050 and many others. The application of an ion exchange membrane as an ion permeable diaphragm has been proposed for other uses such as in water electrolysis.

In cells of the type contemplated, the cathode is in close proximity to or in direct contact with the ion exchange membrane. They must be sufficiently permeable to permit rapid escape of evolved gas from the points of their evolution and to provide ready access of liquid electrolyte to these points as well as rapid removal of evolved alkali or other electrolysis produced from such points. Thus the electrodes are normally quite porous.

According to a well-known method of providing such an electrode, electrode material in the form of very fine powder of catalytic material, i.e. platinum group metal or oxide is mixed with an inert polymeric binder, mainly polytetrafluoroethylene (PTFE).

The mixture is sintered and hot-pressed in a suitable mold, in the form of extremely thin and sufficiently coherent porous film or layer. Said films are then hot-pressed onto the membrane surface to obtain a permanent adhesion to the membrane. Methods of producing such electrodes are described in certain patents assigned to the General Electric Company. One patent which describes such methods is U.S. Pat. No. 3,297,484.

According to another method, it is possible to deposit an adherent and porous layer of metal resistant to corrosion and electrocatalytic on the membrane surface, which may or may not be preroughened by chemical reduction and deposition of the metal from solutions. Said methods are defined "electroless" to distinguish them from the galvanic deposition. This method is described in the Italian Patent Applications SN Nos. 24829 A/79 and 20489 A/80.

One difficulty which has been encountered with permeable cathodes which are in direct contact with or bonded to the membrane is that cathodic efficiency is relatively low, for example 85% or below and that oxygen in appreciable concentration, for example above 0.5 to 1% or more by volume, is evolved in the chlorine produced.

Apparently some portion of the alkali metal hydroxyl evolved at the cathode tends to migrate through the membrane. This may be due to the fact that caustic soda produced at the interface is not sufficiently and uniformly diluted by the catholyte within the cathode compartment of the cell.

The high alkalinity may induce dehydration of the membrane with consequent decrease of the electrical conductivity, moreover the high concentration gradient increases the back-diffusion of the hydroxyl ion toward the anode with a resulting loss of the faraday efficiency.

The creation of varying gradients of alkalinity on or in the membrane may cause membrane shrinking and membrane swelling in localized areas and continual changing of these events and this may result in detachment and/or loss of cathode layer or cathodic material. Whatever the actual mechanism, the adverse results referred to above accrue.

Attempts have been made to avoid these problems by using a membrane which has a weaker acidic section or surface on the cathode side and on the anode side. For examples membranes have been provided wherein the anode side comprises sulfonic or phosphonic groups and the cathode side comprises a cation exchange layer in which the acid groups are largely or even completely carboxylic. In another embodiment the membrane is sulfonic acid or salt thereof on the anode side whereas on the cathode side the membrane surface is largely sulphonamide.

In an effort to reduce the cost of constructing such cells and perhaps to simplify their construction foraminous electrodes (screens foils or the like) which are not bonded to the membrane have been tested. However, it has been noted that this has been accompanied by an increase in cell voltage. This is particularly true when more concentrated alkali containing 25 percent by weight or more of NaOH or equivalent alkali is produced.

THE INVENTION

According to this invention halogen is effectively generated by electrolyzing an aqueous halide in an electrolytic cell having a pair of opposed electrodes separated by an ion permeable separation preferably an ion exchange polymer and where at least one electrode, preferably the cathode, has two surfaces. The first surface is resistant to electrodic and electrolytic attack and has a low overvoltage being readily capable of functioning as an electrode and evolving electrolysis product by electrolysis. The second such surface has a higher overvoltage (hydrogen overvoltage in the case of the cathode surface or chlorine overvoltage in the case of anode surface) and is between the lower overvoltage surface and the membrane, generally being in direct contact with or even bonded to the membrane. Of course both surfaces are electroconductive and are capable of being polarized as an electrode. Furthermore both surfaces are in direct electrical contact so that there is little or substantially no potential difference between them.

As a typical embodiment the cathode may comprise an electroconductive porous metal coating disposed on and bonded to the cathode side of the membrane. Alternatively, the intermediate cathode section may be in the form of electroconductive grid or grate with relatively high hydrogen overvoltage electroconductive surface which is pressed against the cathode side of the membrane.

Since the first or rear most cathode section has a lower hydrogen overvoltage surface than that of the front coating or grid engaging the membrane a major portion and even substantially all of cathodic electrolysis occurs at points spaced by the spacer or barrier from the membrane as distinguished from on or close to the membrane surface.

The cathode where the major electrolysis takes place is readily porous and permits ready flow including lateral flow of catholyte therethrough. Thus it may be in the form of fine mesh flexible electroconductive metal screen having 5 to 10 mesh openings per centimeter or a mat of undulating wire screen or a combination of these elements. The openings are relatively large and thus provide channels adjacent to the points of contact between the conductive spacer and the main cathode section whereby catholyte may flow edgewise along the cathode surface and adjacent these points thereby sweeping away evolved alkali from the front portion of the cathode as well as from the areas more remote from the membrane.

The spacer, barrier or intermediate section is itself quite thin often being less than 5 microns. In contrast the remaining active section is at least 100 microns thick and this is two or more or even 10 or more times the thickness of the spacer. This permits flowing catholyte to have access to the front portions of the cathode a distance only equal to the spacer thickness thereby reducing the probability of localized high alkali concentrations undergoing formation at the membrane surface. Where the spacer is of the same or substantially the same surface composition as the main cathode section some electrolysis may take place on the spacer or in the pores thereof. This amount is reduced by providing a barrier or spacer of higher hydrogen overvoltage than the hydrogen overvoltage of the major active cathode area.

For example, the more active cathode may have a surface comprising a platinum group metal or oxide thereof which has a very low hydrogen overvoltage. In that case the intermediate layer can have an electroconductive surface of a metal or oxide which is higher in overvoltage. A thin porous layer of silver or copper metal or an iron or nickel screen may be used for this purpose. As will be understood other conductive materials which are resistant to corrosion in the alkaline cathode area may also be used.

The intermediate section is any case is porous and permeable to electrolyte. Being quite electroconductive, it may co-operate in transmitting current to the more remove active cathode areas without serious increase in overall voltage.

In one effective embodiment the intermediate cathode section comprises a thin porous film of silver particles deposited on the membrane surface for example by chemical reduction or electroless deposition. The ratio between empty and solid spaces in such a deposit or layer often ranges from 1.2 to 0.5.

In the practice of this method one surface of the membrane is roughened by sandblasting or other method and then the roughened surface is swelled or hydrated with an alkali mild hydroxide solution, preferably diluted aqueous caustic soda or aqueous potash. The alkali treated surface is contacted with a salt solution of the metal to be deposited, preferably silver in the form of a reducible compound such as silver nitrate; the membrane is then contacted with a solution containing hydroquinone.

The hydroquinone, due to the high alkalinity existing at the surface of the membrane, previously treated with the alkali solution, oxidizes the quinone reducing the metal ions absorbed on the membrane surface to metal.

The reduction proceeds until the alkalinity at the membrane surface falls. The reduction progresses only while adequate soda or potash is available at the membrane surface to neutralize evolved hydrogen ion or acidity generated with the oxidation of hydroquinone to quinone. The reduction stops as the alkalinity due to the soda or potash previously absorbed on the membrane is consumed and the pH of the surface proceeds to or toward neutrality or an acidic state.

Due to this fact, the metal grains formed at the surface, do not act as catalytic sites for a further reduction of the metal and the coating thus obtained is finely dispersed highly porous and uniform, with metal grains therein being very small and the coating is quite thin.

As the amount of the deposited metal is strictly determined by the availability of caustic soda and potash in the surface layer of the membrane, it is possible to control the amount and depth of deposited metal by limiting the depth of penetration of soda or potash within the membrane and contacting the pretreated membrane with the solution of the salt of metal to be reduced and then with the solution containing hydroquinone in quick succession.

According to the preferred method one surface of the hydrated membrane is brought in contact with the caustic solution for a time comprised between 30 and 120 seconds, only on the surface to be treated, so that the diffusion of the soda or potash with the membrane takes place at largely or completely the surface whereon the electrode has to be applied.

Usually, the temperature is the room-temperature, although other temperatures may be considered as well.

The concentration of the caustic solution is another determining factor on the depth of penetration of the soda or potash within the thickness of the membrane. A diluted solution tends to swell more the membrane and therefore to facilitate the penetration of soda or caustic. On the contrary, a concentrated solution tends to shrink the membrane, making it more impervious to the internal diffusion of soda or potash.

Preferably, the aqueous alkaline solution used in a soda solution between 2.5 and 20% by weight of NaOH. The diffusion of soda within the membrane is therefore controlled by adjusting the contacting time through the concentration of the solution and the temperature. When the alkali absorption is effected, the membrane surfaced is promptly rinsed with deionized and distilled water, and then contacted with the solution of the metal salt to be reduced. Preferably, this is a solution of silver nitrate with normality between 0.01 and 1 N, more preferably between 0.1 and 0.5 N. The temperature is the room temperature, though different temperatures may be considered.

Usually, the treating times for this metal salt range from 30 to 120 sec., considering that a diluted solution requires a time longer than a more concentrated solution.

The membrane is again rinsed and the surface treated with alkali and then silver salt is contacted with an aqueous solution containing from 10 to 30% of a reducing agent which reduces the metal salt and generates hydrogen ion, such as hydroquinone, for a time ranging from 1 to 15 minutes.

Other modifications of the preferred method hereinabove described are also possible. For example, the membrane may be contacted with soda on both surfaces, whenever it is desired to apply the electrode coating on both surfaces, before proceeding to the reduction with hydroquinone.

Alternatively, other alkali solutions may be used, such as sodium carbonate, or potassium carbonate solutions.

The coatings obtained with this embodiment of the present invention are exceptionally uniform with a thickness which may range from 0.025 to 0.5 micron the thickness being largely controlled by controlling the depth of penetration of the alkali and the subsequent absorption of metal salts. The lateral resistivity of the metal films thus obtained may range between 0.5 to 10 Ohm centimeters.

While the silver film appears continuous to the naked eye, pores or channels extend through its thickness so that the alkali cations are readily transferred through the film as well as the membrane.

The use of a reducing agent such as hydroquinone which generates hydrogen ion in the course of reducing metal salt to metal is especially effective where it is desired to apply a metal coating to a cation exchange membrane and to avoid metal deposition within the interior of the membrane sheet. Since the cation exchange material is itself acidic except to the extent where the exchange groups have been neutralized any generation of hydrogen ion reduces pH. Where as in the case of hydroquinone reduction the metal salt reduction takes place only under an alkaline pH, the reduction stops as the alkalinity falls. Hence, if only the surface is contacted with alkali for a time insufficient to allow substantial alkali penetration below the surface reduction of metal is restricted to the depth of alkali penetration.

The invention is particularly applicable to diaphragms or membranes wherein one side or face thereof is less acidic or comprises a weaker acid than the other. For example, in the case of a membrane having predominately sulfonic groups on one side and predominately carboxylic groups on the other side, an effective silver coating is applied to the weaker acid side, i.e. the carboxylic side. Similarly, where the membrane is sulfamid on one side and sulfonic on the other, the coating is applied to the weaker acid side, i.e. the sulfonamid side. Of course the carboxylic acid may also contain some sulfonic groups, if desired.

At all events the membrane is thus coated with a thin electroconductive porous layer bonded thereto at least on one face. This membrane is installed in a cell with the coating on the cathode side. Such a cell has an electroconductive cathode section which is installed to bear against the above silver coating on its rear face (face remove from the membrane) and this cathode section has a lower hydrogen overvoltage than the porous silver coating.

According to a further embodiment the intermediate cathode section may comprise a screen or grid which is open to electrolyte and gas flow and which is merely pressed against or even embedded in the membrane so long as electrolyte has free access to its surface and evolved gas can escape therefrom. Ordinary iron or nickel screen or graphite cloth which is thin and flexible so that it can bend to accomodate for irregularities in the membrane contour and can permit free electrolyte flow may be used for this purpose. Such screens are electroconductive and have a surface which can function as a cathodic surface but at a higher voltage because of its high hydrogen overvoltage surface.

This screen is backed by the first or principal cathode screen which may be in the form of one or a stack of electroconductive screens and/or and electroconductive compressible wire mat which has a lower overvoltage surface than the intermediate screen. Generally, the electrode area of the low overvoltage surface substantially exceeds often by 25–50% or more the electrode area of the higher overvoltage surface of the front or intermediate cathode section.

According to a further embodiment, the cathode may comprise a single structure such as a compressible electroconductive mat or a screen or grill work with two electroconductive electrode surfaces one of which has a lower hydrogen overvoltage aligned with respect to the membrane so that the high overvoltage surface bears against the membrane with the lower overvoltage surface being spaced therefrom.

In all of the above embodiments the higher overvoltage cathode surface may comprise metallic iron or nickel or silver, silver alloy etc., while lower overvoltage surface may comprise a platinum group metal or electroconductive oxide (platinum, ruthenium, palladium etc.) as a coating on a nickel or iron screen as an alloy or mixed oxide of such platinum group metal and nickel. Also such lower overvoltage surface may comprise a conductive sulfide such as nickel or iron sulfide or mixtures thereof with iron or nickel metal or oxide.

Generally the difference in hydrogen overvoltage between the two surfaces should not be excessive and preferably they do not differ by more than about 0.5 volts at current densities in the range of 2 to 5 $KA/m^2$ and preferably comprised between 0.1 and 0.5 volts.

If desired, the membrane surface may be roughened or abraded, for example by sandblasting, sputter etching, embossing or other means to increase its surface area. The cathode is then pressed into unbonded contact with such rough surface.

In such a case the surface area of the abraded surface of a membrane of given size generally is at least about 25 percent and often 50% of above greater than the surface area of a membrane of such size or dimension with a smooth surface. For example, a square membrane sheet one meter square has an overall or enclosed area of one square meter. However, by adequate sandblasting, the sheet may be roughened enough to increase its surface area to 1.25–1.5 square meters or even higher although the overall area or its bulk edge to edge cross sectional area enclosed by the periphery of the sheet remains the same.

Generally the depth of penetration of the pitted or roughened area is small, rarely exceeding about 25 micron and generally the depth of the roughened area is below 10 microns, generally being below 5 microns. Also the average distance between crests of the roughened area is small, rarely exceeding 50 microns and preferably being below 10 microns, usually being 0.1 to 5 microns.

The roughening of the membrane surfaces may be achieved by sandblasting the membrane with sand or quartz particles of 50 to 150 microns for a few seconds up to one or two minutes.

Also it may be accomplished by cathode sputter etching or by embossing the sheet or by casting the sheet in contact with a roughened mold surface.

Figure 2:
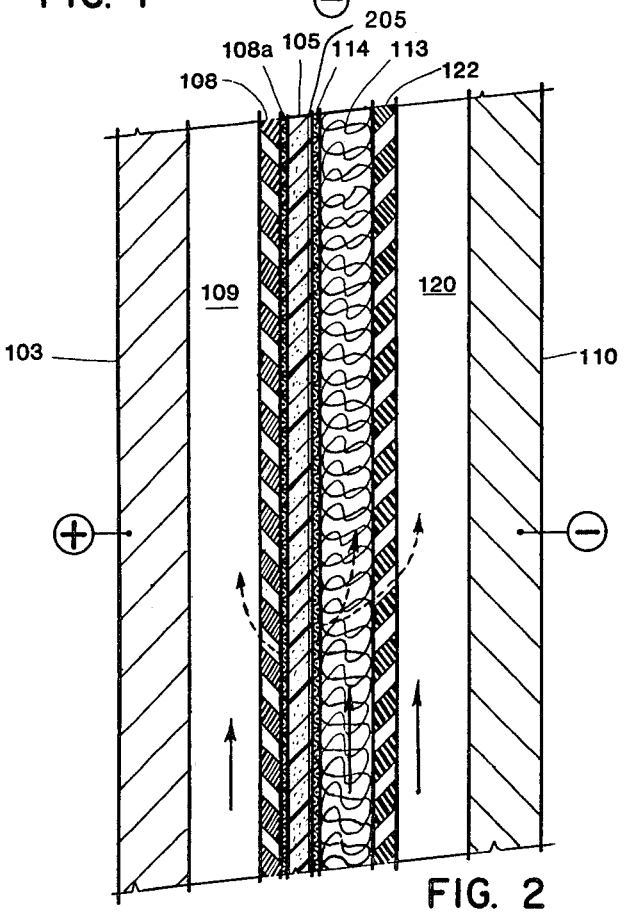

The invention herein contemplated may be applied to an electrolytic cell such as the one diagrammatically illustrated in the accompanying drawing in which:

FIG. 1 is a diagrammatic horizontal sectional view of the cell having the double surfaced electrode installed therein, and FIG. 2 is a diagrammatic vertical sectional view of the cell of FIG. 1.

As shown, the cell comprises an anode end plate 103 and a cathode end plate 110, both mounted in a vertical plane with each end-plate in the form of a channel having side walls respectively enclosing an anode space 106 and a cathode space 111. Each end plate also has a peripheral seal surface on side-walls projecting on each side of the cell from the plane of the respective end plate, 104 being the anode seal surface and 112 being the cathode seal surface. These surfaces bear against a membrane or diaphragm 105 which stretches across the enclosed space between the side walls separating anode from cathode. In one embodiment, this membrane is provided on the cathode side with the roughened surface with a cathode screen bearing against the rough surface. In another the membrane may be coated with silver, copper or the like porous coating 205 as described above.

The anode 108 may comprise a relatively rigid uncompressible sheet of expanded titanium metal or other perforate, anodically resistant substrate, preferably having a non-passivable coating thereon such as a metal or oxide or mixed oxide of a platinum group metal. This sheet is sized to fit within the side walls of the anode back plate and is supported rather rigidly by spaced electroconductive metal or graphite ribs 109 which are fastened to and project from the web or base of the anode end plate 103. The spaces between the ribs provide for ready flow of anolyte which is fed into the bottom and withdrawn from the top of such spaces. The entire end plate and ribs may be of graphite and alternatively, it may be of titanium clad steel or other suitable material. The rib ends bearing against the anode sheet 108 may or not be coated, e.g. with platinum or like metal to improve electrical contact and the anode sheet 108 may, if desired, be welded to the ribs 109. The anode rigid foraminous sheet 108 is held firmly in an upright position. This sheet may be of expanded metal having upwardly inclining openings 10 directed away from the membrane (see FIG. 2) to deflect rising gas bubbles towards the space 109 and away from the membrane.

More preferably, a fine mesh pliable electrolyte permeable screen **108*a* of titanium or other valve metal coated with a non-passivatable layer which is advantageously a noble metal or conductive oxides having a low chlorine overvoltage for the anodic reaction (e.g. chlorine evolution), is disposed between the rigid foraminous sheet 108 and the membrane 105. The screen 108*a* usually a fine mesh screen provides a density of contacts of extremely low area with the membrane in excess of at least 30 contacts per square centimeter. It may be spot welded to the coarse anode screen 108** or not, as desired.

On the cathode side, ribs 120 extend outward from the base of the cathode end plate 110 a distance which is a fraction of the entire depth of the cathode space 111. These ribs are spaced across the cell to provide parallel space for vertical electrolyte flow from bottom to top and engage the cathode which is in sheet or layer form, i.e. its thickness dimension is much less than its width and height. The cathode end plate and ribs may be made of steel or a nickel iron alloy or other cathodically resistant electroconductive material. On the conductive ribs 120 is welded a relatively rigid pressure plate 122 which is perforate and readily allows circulation of electrolyte from one side thereof to the other. Generally these openings or louvers are inclined upward and away from the membrane or compressible electrode toward the space 111 (see also FIG. 2). The pressure plate is electroconductive and serves to impart cathodic polarity to the electrode and to apply pressure thereto and it may be made of expanded metal or heavy screen of steel, nickel, copper or alloys thereof.

A relatively fine flexible screen 114 bears against the rough surface of the membrane or against the coating 205, if present on the cathode side of the active area of diaphragm 105. This screen because of its flexibility and relative thinness, assumes the contours of the diaphragm and therefore that of anode 108. A metal screen mat 113 is disposed behind the screen and this compressible mat is cathodic and serves as part of the cathode. The screen 114 is composed of nickel wire or other electroconductive cathodically resistant wire which has a surface of low hydrogen overvoltage (lower than the silver) and may be coated with a low hydrogen overvoltage coating such as coating of a platinum group metal or oxide thereof.

Preferably two or more electroconductive metal screens are interposed between the rough membrane surface and the compressible mat 113. In such a case it is often advantageous to provide a screen of relatively higher hydrogen overvoltage in direct contact with the membrane surface and a second screen or bank of screens which have a surface or relatively lower hydrogen overvoltage behind but in contact with the higher overvoltage screen. In that case the high overvoltage screen surface may be of iron or steel or nickel whereas the surface of the more remote screen or screens may comprise a coating of platinum group metal or conductive oxide thereof or nickel sulfide or other low overvoltage coating. Usually the differential in hydrogen overvoltage between the two types of surfaces ranges from 0.05 to 0.5 volts, rarely being above 0.6 volts. Of course the screen surfaces are in close electrical contact with each other since the screens are pressed tightly together and against the membrane by the compressible mat and are essentially at the same electrical potential.

The screens advantageously are fine in mesh and provide many contacts of low area with the membrane and with the next adjacent screen, usually being at least 30 contacts per square centimeter. A compressible electroconductive wire mat 113 is disposed between the cathode screen 114 and the cathode pressure plate 122.

As illustrated in FIG. 1, the mat 113 is a crimped corrugated or wrinkled compressible wire-mesh fabric which fabric is advantageously an open mesh knitted-wire mesh of the type described in U.S. application for U.S. patent Ser. No. 102629 filed Dec. 11, 1979 wherein the wire strands are knitted into a relatively flat fabric with interlocking loops. This fabric is then crimped or wrinkled into a wave or undulating form with the waves being close together, for example 0.3 to 2 centimeters apart, and the overall thickness of the compressible fabric is 2 to 10 millimeters. The crimps may be in a zig-zag or herringbone pattern and the mesh of the fabric is coarser, i.e. has a larger pore size than that of screen 114. Both the screen 114 and the mat generally have pore or void size substantially larger than the pore size of coating 205.

As illustrated in FIG. 1, this undulating fabric 113 is disposed in the space between the finer mesh screen or screens 114 and the more rigid expanded metal pressure plate 122. The undulations extend across the space and the void ratio of the compressed fabric is, notwithstanding compression, preferably higher than 75%; preferably between 85 and 96%, of the apparent volume occupied by the fabric. The waves extend in a vertical or inclined direction so that channels for upward free flow of gas and electrolyte are provided which channels are not substantially obstructed by the wire of the fabric. This is true even when the waves extend across the cell from one side to the other because the mesh openings in the sides of the waves permit free flow of fluids.

The end-plates 110 and 103 are clamped together and bear against membrane 105 or a gasket shielding the membrane from the outside atmosphere disposed between the end walls. The clamping pressure compresses the undulating fabric 113 against the finer screen or screens 114 and the metal coating or the roughened membrane to the thickness substantially less than the fabric in it uncompressed state. This in turn presses the screen 114 against the membrane and thus, the anode surface of the membrane presses against anode 108*a*.

In the operation of this embodiment, substantially saturated sodium chloride aqueous solution is fed into the bottom of the anolyte compartment of the cell and flows upward through channels or spaces 105 between ribs 109 and depleted brine and evolved chlorine escapes from the top of the cell. Water or dilute sodium hydroxide is fed into the bottom of the cathode chamber and rises through channels 111 as well as through the voids of the compressed mesh sheet 113 and evolved hydrogen and alkali is withdrawn from the top of the cell. Electrolysis is caused by imparting a direct current electric potential between the anode and cathode end plates.

As shown in FIG. 2, at least the upper openings in pressure plate 122 are louvered to provide an inclined outlet directed upwardly away from the compressed fabric 113 whereby some portion of evolved hydrogen and/or electrolyte escapes to the rear electrolyte chamber 111. Therefore, the vertical spaces at the back of the pressure plate 122 and the space occupied by compressed mesh 113 are provided for upward catholyte and gas flow.

By recourse to two such chambers, it is possible to reduce the gap between pressure plate 122 and the membrane and to increase the compression of sheet 113 while still leaving the sheet open to fluid flow and this serves to increase the overall effective surface area of the active positions of the cathode.

According to the improved method of this invention for the electrolysis of sodium chloride, aqueous brine containing from 140 to 300 grams per liter of sodium chloride is circulated within the anode compartment of the cell. Chlorine is evolved at the anode, while the solvated ions tend to migrate through the cation membrane and reach the cathode where caustic soda of substantial concentration above 15–20% by weight and hydrogen is evolved. Solutions containing 25 to 40% by weight of alkali metal hydroxide may be produced with anode and cathode efficiencies above 90% frequently above 95%.

It will be seen that the cathodically polarized section includes the end plate 110 and pressure plate 122 mat 113 and the screen or assembly of screens 114 which bear against the membrane.

The screen or the rear screen and/or the mat 113 is coated with a coating or surface which has a low or substantially negligible hydrogen overvoltage. Typical coatings include a mixture of nickel and conductive ruthenium oxide, platinum black or platinum metal or other such coating of a low hydrogen overvoltage material. The depth of this active area may be expanded by coating the compressible wire fabric 113 with the same material.

Since electrolyte flow is rapid through the compressed fabric 113 and the mesh of the screen 114, a large portion of the sodium hydroxide produced may be evolved a distance away from the membrane surface and is removed by the flowing electrolyte.

In the embodiment where the membrane is provided with a thin porous metal coating of silver, copper or the like the coating becomes polarized as a cathode. However, generation of caustic and chlorine at such coating is small or even substantially nonexistent relative to the amount generated on the screen 114 and or compressed fabric 113 for at least two reasons, first it has a higher hydrogen overvoltage than the surface on screen 114 or 113 and second because its area is comparatively smaller because it has a thickness less than 1 to 2 microns as discussed above. Consequently, only a small portion of the evolved caustic tends to back migrate toward the anode.

The thin silver layer may thus constitute a less active porous spacer element between the membrane and a more active cathode area where the bulk of the caustic is generated and swept away. This more larger active area is readily permeable to edgewise electrolyte flow promoting rapid removal of caustic not only from the active cathode surfaces but from the pores of the thin silver coating.

If the silver coating is thickened the path of flow of evolved caustic through the coating is lengthened thus hindering although not necessarily completely preventing escape of caustic evolved therein. However, this may tend to promote the undesirable back migration discussed above. Thus it has been considered desirable to limit thickness of the layer to a maximum of 2 to 5 microns preferably not over 2 microns and more advantageously below one micron.

The active screen as well as the fabric 113 have openings much larger than the pores of the silver coating. Thus such openings may be 0.1 centimer wide or even more and in case of the fabric 113 the voids exceed the solid wire sections by several times. As a consequence electrolyte may flow in an edgewise direction through fabric 113 as illustrated in FIG. 2 as well in a ramdom path around, along and through the open mesh of screen 114.

It will be understood that other embodiments of the invention may be provided. While a silver coating having a thickness below one micron, usually below 0.5 micron, is especially effective in promoting cathode efficiency of 95% or above, the silver coating may be thickned as by electrodeposition or further electroless coating so long as good porosity of the coating is retained. Generally, however, this coating is less than about 5 microns and rarely above one or two microns in thickness.

Although the metal coating 205 is porous, the coating may appear continuous to the naked eye. Thus the pores or voids are much smaller than those in either the screen or the mat. This small pore size may be the reason the coating appears to be a barrier which may restrain back migration of alkali to the area of the anode.

At all events the cell is capable of operation at cathode Faraday efficiencies of 95% and above with less than 0.5% if even substantially no oxygen in chlorine evolved at the anode. In contrast where the coating is omitted cathode efficiencies of 85–88% and oxygen concentration of 1–2% by volume in the chlorine have been observed.

The following examples are illustrative:

EXAMPLE 1

The cation exchange membrane is a sheet having a thickness of 0.3 millimeters constituted by two layers of cation resin laminated together with an interlayer of polytetrafluoroethylene screen as mechanical support, one layer is made of a copolymer of tetrafluoroethylene and perfluorovinylether sulfonyl fluoride (or acid) having an equivalent weight of 1100 and the other layer consisting of a copolymer of tetrafluoroethylene and a perfluorovinyleter containing carboxylic groups and having an equivalent weight approximately in the same ranges.

It is sanblasted on the cathode surface represented by the layer or resin containing carboxyl groups by means of quartz particles having a size comprised between 50 and 150 microns, sprayed by means of compressed air at 5 atmospheres pressure through a nozzle kept at 25 millimeters from the membrane surface.

The membrane is then hydrated by soaking in a deionized and distilled water for about 2 hours at a temperature from 60° to 80° C.

The membrane is then placed on the bottom of a watertight container consisting in a flat bottom and a frame laid on the perimeter of the membrane with the carboxylic side up. An aqueous solution containing 10% by weight of caustic soda is poured on the membrane at room temperature and left for 60 seconds. Then the solution is removed and the membrane surface was quickly rinsed with distilled water.

An aqueous solution 0.15 N of silver nitrate is then poured on the treated carboxylic surface of the sheet in the same container, at room temperature, and left for 60 seconds.

The membrane surface is rinsed again with distilled water and an aqueous solution containing 20% of hydroquinone is then poured on the sheet in the container and left for 10 minutes. A silver layer is deposited on the carboxylic side of the membrane coating the sulfonic acid side of the membrane uncoated. The weight of silver is about 0.5 grams per square meter of membrane surface.

The morphology of the silver layer deposited on the carboxylic side of membrane is then observed under an electronic microscope. The silver layer appears constituted by finely dispersed crystals having dimensions varying from 0.01 micron to 0.1 micron. The thickness of the silver layer substantially corresponds to the sizes of the crystals and the porosity degree, expressed as the ratio between full and empty spaces of the projected area, is comprised between 1.2 and 0.5 and ranges from 0.1 to 0.5 micron.

Figure 3:
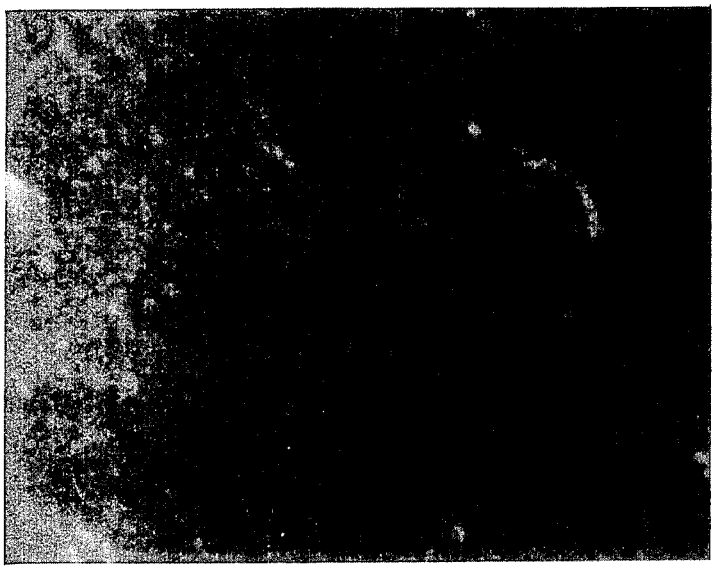

FIG. 3 is an enlargement, magnified 80.000 times, of the silver electrode so deposited on the membrane.

Figure 4:
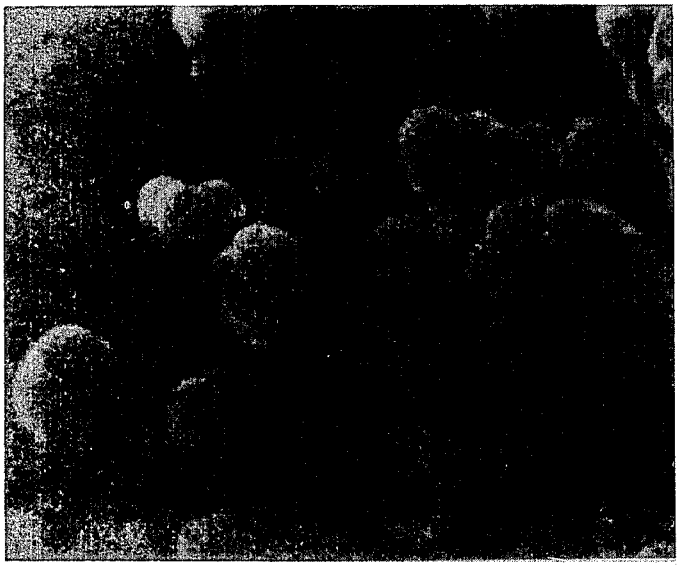

For comparison purposes, FIG. 4 shows an enlargement at a magnification of 10,000, of a palladium electrode obtained via following the reduction method disclosed in Example 1 of the Italian Patent application Ser. No. 20.489 A/80.

From the comparison of the two electrodic layers, it is clear that the palladium electrode obtained via "electroless" exhibits a typical structure of growth with large modular grains and agglomerates, several (about 10) micron thick and the membrane appears to be completely shielded by the metallic layers, conversely the silver electrode of the invention shows a thinner structure characterized by finely dispersed smaller grains with a high porosity degree.

The lateral resistivity of the silver electrodic layer measured by a microhmeter is about 7 ohm centimeters.

EXAMPLE 2

The membrane/electrode system obtained according to the method of the foregoing example, was arranged in a laboratory cell similar to that illustrated in FIGS. 1 and 2 and consisting of two compartments separated by the coated membrane with the silver coating on the cathode side.

The anode was an expanded sheet of titanium, coated with an electrocatalytic layer of titanium and ruthenium mixed oxide supplied by Permelec S.p.A. of Milan, under the trade mark of DSA ®. The low overvoltage cathode section was a micronet with 9 meshes per cm., galvanically coated with an alloy of nickel (50%) and ruthenium (50%), directly pressed against the silver layer deposited on the membrane surface. Moreover, the current conducting system comprised an undulating crimped resilient mat about 0.5 centimeters thick made of knitted nickel wire having a diameter of 0.11 millimeters pressed against the micro-net by means of an expanded sheet made of low-carbon containing steel, substantially rigid and connected to the negative pole of the electric current source.

The electrode surface was about 240×240 millimeters.

Sodium chloride brine was flowed through the anolyte chamber and electrolyzed under the following conditions:

| | |
|---|---|
| anolyte concentration | 20 g/l of NaCl |
| anolyte pH | 4 to 4.5 |
| temperature | 80° C. |
| sodium hydroxide concentration in the catholyte | 25% by weight |
| current density | 3300 Amperes per Square Meter |

Under these conditions the cell operating data were as follows:

| | |
|---|---|
| Cell voltage between the external connectors | Initial voltage 3.0 gradually rising to 3.32 volts |
| Faradic efficiency on soda production | 97% |

Oxygen in the chlorine below 0.2 percent is observed in this type of experiment.

EXAMPLE 3

Further such cation membrane sheet have been coated on the carboxylic layer surface with silver electrode prepared according to the method described in Example 1, varying opportunely the conditions for controlling the quantity and therefore the thickness of the electrodic layer.

The conditions used for each sample and the relevant electrodic thicknesses obtained are listed in the following Table I.

TABLE I

| | Absorption in NaOH | | | Absorption in $AgNO_3$ | | | |
|---|---|---|---|---|---|---|---|
| Sample | NaOH Conc. % by Weight | Temp. °C. | Contact Time Sec. | Normality N | Temp. °C. | Contact Time Sec. | Thickness of Silver Layer MICRON |
| A | 20 | 24 | 60 | 0.1 | 24 | 60 | 0.02 |
| B | 10 | 24 | 60 | 0.1 | 24 | 60 | 0.025 |
| C | 10 | 25 | 60 | 0.1 | 26 | 60 | 0.01 |
| D | 2.5 | 25 | 60 | 0.1 | 25 | 60 | 0.02 |
| E | 2.5 | 25 | 60 | 1 | 25 | 60 | 0.04 |
| F | 1 | 24 | 120 | 0.01 | 24 | 120 | 0.015 |
| G | 1 | 24 | 120 | 0.1 | 24 | 60 | 0.01 |

The various samples of Table I have been tested as membrane/cathode systems in the same cell and under the same conditions of Example 2, for the electrolysis of sodium chloride. The results obtained for each sample are listed in the following Table II.

TABLE II

| Sample | Cell Voltage V | Caustic Soda Faradic Yield % |
|---|---|---|
| A | 3.15 | 97 |
| B | 3.2 | 97 |
| C | 3.3 | 97 |
| D | 3.2 | 97 |
| E | 3.3 | 95 |
| F | 3.3 | 96 |
| G | 3.2 | 96 |

EXAMPLE 4

The membrane treated is a fluorocarbon polymer cation exchange membrane which is a laminate of two layers. One of these layers is a copolymer of a polyfluoroethylene (tetrafluoroethylene) and a perfluorovinylether sulfonylfluoride (or/and) having an equivalent weight of about 1100. The other layer is a sheet of a copolymer of the polyfluoroethylene (tetrafluoroethylene) and a perfluoroethylene other which contains carboxylic groups. This carboxylic sheet also has an equivalent weight of about 1100.

The two layers are laminated together with an interlayer of polytetrafluoroethylene screen to provide mechanical support. The thickness of the membrane is 0.3 millimeters.

Square sheets of this type of membrane 10 centimeters by 10 centimeters are sandblasted on the carboxylic surface with quartz particles ranging in size from 50 to 150 microns sprayed by compressed air at 5 atmospheres pressure through a nozzle maintained at a distance of 25 millimeters from the membrane surface over a period of about 30 seconds. The carboxylic surface of such sheets is thus roughened.

The treated sheet is assembled in different cells of the type described above after conditioning by heating at about 80° C. in an aqueous solution containing 2–3 percent by weight of sodium chloride until the dimensions of the sheet (swelling) has stabilized.

The cell has anodes as described above comprising expanded titanium metal with a ruthenium oxide coating thereon. A ruthenium oxide coated titanium screen is interposed between the expanded metal and the anode (sulfonic) side of the membrane. The sheets are installed with the sandblasted carboxylic surface on the cathode side. As illustrated in the drawing and described above, the cathode comprises a cathode backplate and pressure plate engaging a compressible knitted metal crimped compressible mat 113 which compresses against the screen or screens which in turn are pressed against the membrane surface.

In two tests (Runs 1 and 2) a single screen is pressed against the surface of the membrane by the compressible mat. In other tests (Runs 3, 4 and 5) a spacer screen (second screen) of relatively high hydrogen overvoltage is sandwiched between the surface of the membrane and the low hydrogen overvoltage first screen. The order of the arrangement of cathode parts is: Pressure plate-mat-first screen-second screen-membrane.

The cells are operated circulating aqueous brine containing 215 to 225 grams per liter of sodium chloride through the anolyte compartment and aqueous sodium hydroxide through the catholyte compartment with enough alkali hydroxide withdrawn and water added to the catholyte to maintain the hydroxide concentration at 30% by weight NaOH. Voltage imposed is enough to achieve the specified current density.

Results are obtained as stated in the following table with cathode and anode current efficiencies of 96% or above.

TABLE III

| | Surface Composition | | | | Observed Voltage (Volts) | |
|---|---|---|---|---|---|---|
| Run | Pressure Plate | Mat Surface | First Screen | Second Screen | 2000 Amperes per Square Meter | 3000 Amperes per Square Meter |
| 1 | Nickel | Nickel | Nickel | — | 3.26 | 3.58 |
| 2 | " | " | Nickel Ruthenium Alloy | — | 3.23 | 3.48 |
| 3 | " | " | " | Nickel | 3.11 | 3.41 |
| 4 | " | " | " | Conductive Nickel Oxide Coating | 3.12 | 3.38 |
| 5 | " | " | Iron Sulfide | " | 3.10 | 3.38 |

In these tests water circulation is controlled to produce 30% by weight of NaOH. Temperature of the cell was maintained at 65°–70° C.

EXAMPLE 5

In a further series of tests membrane sheets 14 by 14 centimeters are sandblasted and assembled in similar cells with results as obtained in the following table:

TABLE IV

| | Surface Composition | | | | Observed Voltage (Volts) | |
|---|---|---|---|---|---|---|
| Run | Pressure Plate | Mat Surface | First Screen | Second Screen | 2000 Amperes per Square Meter | 3000 Amperes per Square Meter |
| 6 | Nickel | Nickel | Nickel Ruthenium Oxide | Nickel | 3.20 | 3.29 |
| 7 | Iron | " | " | Nickel-Silver | 3.10 | 3.19 |
| 8 | Nickel | " | " | Nickel | 3.16 | 3.24 |

In the above tests 30% by weight sodium hydroxide is obtained in tests 6 and 8 and 21–23 NaOH obtained in Test no. 7.

EXAMPLE 6

The following table summarizes results obtained in further tests. The anode used comprised titanium screen pressed against a finer titanium screen which was pressed against the membrane. Both screens were coated with conductive ruthenium oxide. Sodium chloride solution containing 230 grams per liter of NaCl and having a pH of 3.5 was circulated at a temperature of 65°–75° C. through the anolyte chamber. The current density was 3000 Amperes per square meter. In all the cases the membrane has been sandblasted on the cathode side with quartz particles for 30 seconds. The cathode alignment was as stated in table V. The results were as follows:

TABLE V

| | Surface Composition | | | | Observed |
|---|---|---|---|---|---|
| Run | Pressure Plate | Mat Surface | First Screen | Second Screen | Voltage Volts |
| 10 | Nickel | Nickel | Iron Coated with Iron Sulfide | Nickel | 3.25 |
| 11 | " | " | " | One millimeter graphite cloth | 3.68 |

TABLE V-continued

| Run | Surface Composition: Pressure Plate | Mat Surface | First Screen | Second Screen | Observed Voltage Volts |
|---|---|---|---|---|---|
| 12 | " | " | " | Nickel Coated with Cadmium | 3.32 |

The above process may be conducted in the electrolysis of aqueous alkali metal chloride containing 150 to 325 grams per liter of alkali metal chloride and the amount of water fed to the catholyte chamber being controlled to produce a convenient concentration of NaOH ranging from 5 to 40 or more, preferably 25 to 40 percent NaOH by weight. Other alkali metal halides or other aqueous halides including hydrochloric acid and other metal halides may be electrolyzed to produce the corresponding halogens (chlorine, bromide include etc.). Furthermore water may be electrolyzed with the cell herein described to produce oxygen and hydrogen.

Although the present invention has been described with particular reference to specific details of certain embodiments thereof, it is not intended that such details shall be regarded as limitations upon the scope of the invention, except insofar as included in the accompanying claims.

What is claimed:

1. A method of generating halogen which comprises electrolyzing an aqueous halide in an electrolytic cell having a pair of opposed electrodes separated by an ion exchange separator at least one of said electrodes having a first electroconductive electrolyte resistant metal screen of relatively low overvoltage and a second electroconductive metal screen of higher overvoltage between the separator and the first metal screen.

2. The method of claim 1 wherein the electrode comprising said metal screens is a cathode and the hydrogen overvoltage of the second screen exceeds the hydrogen overvoltage of the first screen.

3. The method of claim 1 or 2 wherein said second screen is in contact with the separator.

4. The method according to claims 1 or 2 wherein the area of said first screen exposed to electrolyte is greater than the area of said second screen.

5. The method according to claims 1 or 2 wherein the overvoltage of the second screen is not more than 0.5 volts above the overvoltage of the first screen.

6. The method of claim 1 wherein the electrode comprising said metal screens is an anode and the chlorine overvoltage of the second screen exceeds the chlorine overvoltage of the first screen.

7. The method according to claims 1 or 2, wherein the separator is a fluorocarbon polycarboxylic acid resin.

8. The method of claim 1 wherein the high overvoltage section is metallic silver.

9. A method of generating halogen by electrolysis of aqueous halide which comprises conducting the electrolysis between the anode and cathode separated by an ion exchange membrane wherein the cathode comprises a relatively thick electrolyte permeable cathode section spaced from the membrane by an intervening relatively thin electroconductive metal screen in contact with both the membrane and the relatively thick section, said thin electroconductive metal screen having a higher hydrogen overvoltage than said thick section.

10. The method of claim 9 wherein the thin screen has a thickness not in excess of 5 micron.

11. The method of claim 9 or 10 wherein the relatively thick section has a surface comprising a platinum group metal or an electroconductive oxide of said metal.

12. An electrolytic cell comprising a pair of electrodes separated by an ion exchange separator at least one of said electrodes having a first electroconductive electrolyte resistant metal screen of relatively low overvoltage and a second electroconductive surface of higher overvoltage between the separator and the metal screen.

13. The cell of claim 12 wherein the second metal screen has a higher hydrogen overvoltage than said first metal screen.

14. The cell of claim 12 wherein the second screen has a higher chlorine overvoltage than said first metal screen.

15. The cell of claim 12 wherein the surface area of said first surface exposed to electrolyte is greater than the surface area of said second metal screen.

16. The cell according to claims 13, 14, or 15 wherein the separator is a fluorocarbon polycarboxylic acid resin.

17. A method of generating halogen, alkali, and hydrogen by electrolysis of aqueous alkali metal halide which comprises conducting said electrolysis in a cell having an anode and a cathode separated by an ion exchange membrane at least one of said electrodes being multilayered and comprising a plurality of open wire mesh screens in electrical contact with each other and having an inner screen adjacent the membrane, said inner screen having a surface of higher overvoltage than an outer screen and in electrical contact therewith, said inner screen being thinner than said outer screen, feeding said solution to the anode, and feeding water to the cathode, and evolving hydrogen and alkali at the cathode.

18. The method of claim 17 wherein the multilayered electrode is a cathode and the inner screen has a higher hydrogen overvoltage than the outer screen.

19. The method of claim 18 wherein the membrane is coated with a thin porous layer of particles having a high hydrogen overvoltage.

20. The method of claim 17 or 19 wherein said thicker portion comprises a compressible electroconductive wire mat.

21. The method of claim 20 wherein the inner screen is nickel or stainless steel and the compressible mat has a coating of a platinum group metal or oxide thereof.

22. The method of claim 1 wherein the second screen has a surface comprising a metal sulfide.

* * * * *